US005645711A

United States Patent [19]

Hraban et al.

[11] Patent Number: 5,645,711

[45] Date of Patent: Jul. 8, 1997

[54] PROCESS FOR UPGRADING THE FLASH ZONE GAS OIL STREAM FROM A DELAYED COKER

[75] Inventors: Thomas L. Hraban; Paul E. Seyler, both of Ponca City, Okla.; Todd W. Dixon, Lake Charles, La.

[73] Assignee: Conoco Inc., Ponca City, Okla.

[21] Appl. No.: 583,576

[22] Filed: Jan. 5, 1996

[51] Int. Cl.[6] ..... C10G 9/14

[52] U.S. Cl. ..... 208/131; 208/50; 208/132

[58] Field of Search ..... 208/50, 131, 132

[56] References Cited

U.S. PATENT DOCUMENTS

| | | | |
|---|---|---|---|
| 4,514,898 | 5/1985 | Allan | 208/131 |
| 4,518,487 | 5/1985 | Graf et al. | 208/131 |
| 4,797,179 | 1/1989 | Mallari | 208/131 |
| 5,143,597 | 9/1992 | Sparks | 208/131 |

*Primary Examiner*—Helane E. Myers

[57] ABSTRACT

A delayed coking process in which a flash zone gas oil stream from the bottom of the coker fractionator is upgraded by removing suspended solids and then hydroprocessing the stream to make it more attractive as a feed to a fluidized bed catalytic cracking unit or other processing unit. Removal of the solids allows the stream to be processed in a fixed bed catalytic hydrotreater without plugging of the catalyst bed.

8 Claims, 3 Drawing Sheets

PROCESS FOR UPGRADING THE FLASH ZONE GAS OIL STREAM FROM A DELAYED COKER

BACKGROUND OF THE INVENTION

1. Field of the Invention

This invention relates to delayed coking, and more particularly to a delayed coking process in which overhead vapors from a coke drum are passed to a coker fractionator where the coker overheads are separated into a vapor stream, intermediate liquid streams, and a bottom flash zone gas oil stream.

2. Background Art

A coking process of the type referred to above is described in detail in U.S. Pat. No. 4,518,487 to Graf et al. As described in that patent, the product yield distribution from the coker is enhanced by removing a flash zone gas oil stream from the bottom of the coker fractionator rather than returning the stream to the coke drum as coker recycle as was done in earlier coking processes, all as described in detail in the aforementioned U.S. Pat. No. 4,518,487.

While the process described in the "487" patent provides significant improvements, it is subject to the disadvantage of producing a flash zone gas oil stream that is difficult to upgrade for further processing. The stream contains significant amounts of finely divided particulate solids as well as heavy viscous mesophase material. The mesophase material is essentially liquid coke which is entrained in the vapors leaving the coke drum. In order to enhance the value of the flash zone gas oil stream, it needs to be hydrotreated. However, the entrained solids and mesophase material rapidly plug and foul the catalyst bed of a hydrotreater when it is attempted to pass the stream through a hydrotreater. The unhydrotreated flash zone gas oil can be processed in a fluidized bed catalytic cracking unit (FCC unit), but the yield distribution of the unhydrotreated stream is poor due to its high aromatic content and other factors. Prior attempts to filter the flash zone gas oil stream so that it could be hydrotreated have been unsuccessful due to rapid filter plugging, difficulty in regenerating the filter medium, and other factors.

SUMMARY OF THE INVENTION

According to the present invention, the flash zone gas oil stream is filtered to remove substantially all of the solids which would otherwise foul a catalyst bed in a hydrotreater. The reduced solids stream is then passed to a fixed bed catalytic hydroprocessor such as a hydrodesulfurizer or a hydrocracker to reduce the sulfur content of the stream and to modify the molecular structure of the stream components to enhance their value in a subsequent processing unit.

The product yield distribution from a fluidized bed catalytic cracker (FCC unit) is significantly better for a hydrotreated flash zone gas oil as compared to the product yield distribution from an untreated flash zone gas oil.

BRIEF THE DRAWINGS

DESCRIPTION OF THE PREFERRED EMBODIMENTS

Figure 1:
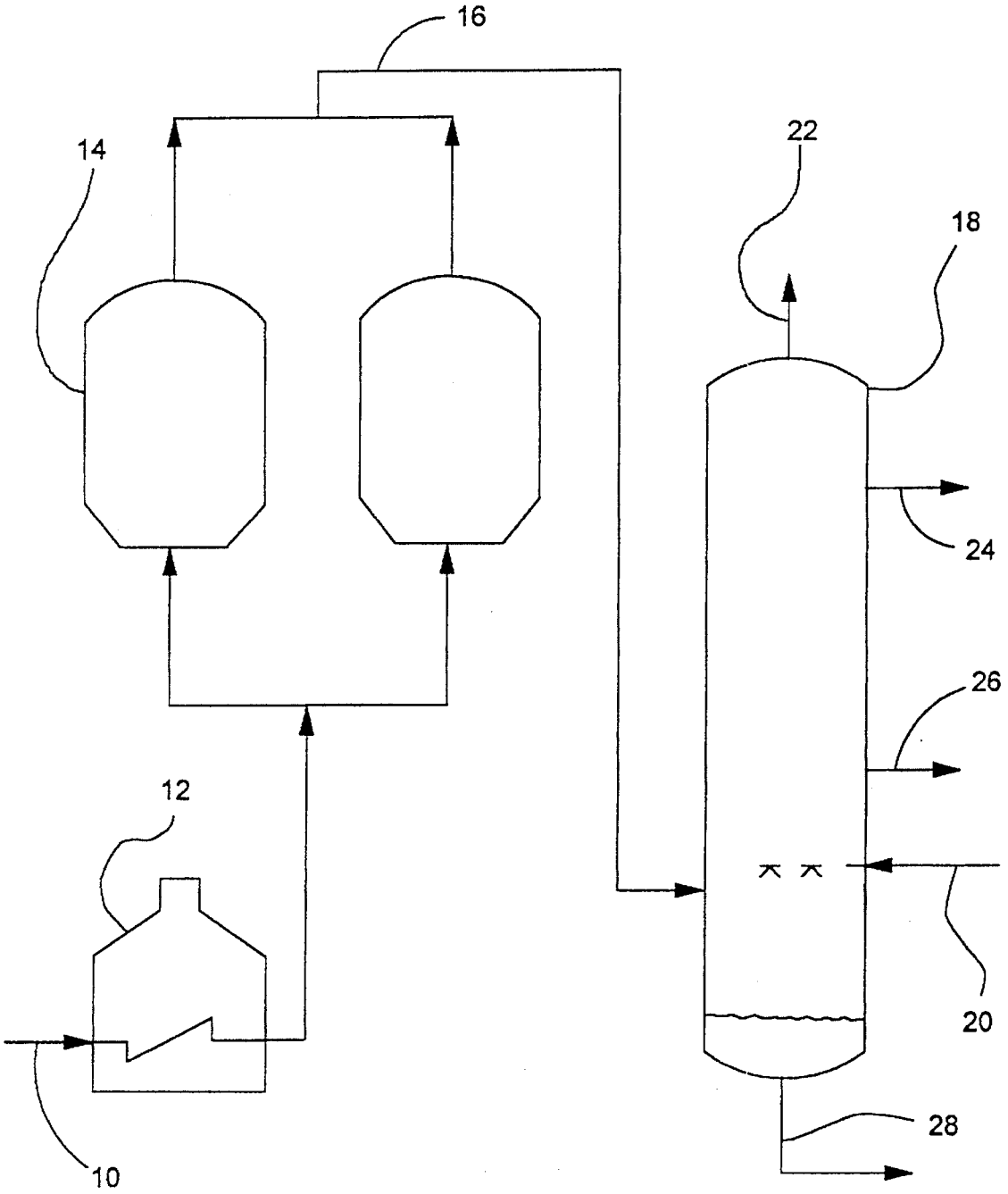
Figure 1 Prior Art
FIG. 1 is a schematic flowsheet showing a prior art coking process of the type to which the present invention pertains.

FIG. 1 is a simplified flowsheet illustrating the coking process described in U.S. Pat. No. 4,518,487. As shown in FIG. 1, coker feed from line 10 passes through furnace 12 and then to one of the coke drums 14. Overhead vapors from drum 14 pass via line 16 to coker fractionator 18. A recycle liquid such as a coker gas oil is sprayed into the flash zone of fractionator 18 via line 20 to contact incoming vapors to knock down suspended particulate matter and to condense higher boiling components in the incoming coker vapor stream. A wet gas overhead stream is removed from fractionator 18 via line 22, and intermediate liquid fractions are removed via lines 24 and 26. A flash zone gas oil containing suspended solids and viscous mesophase material is removed from the bottom of fractionator 18 via line 28. In the prior art, this flash zone gas oil stream (FZGO) is typically .added to the feed of an FCC unit.

Figure 2:
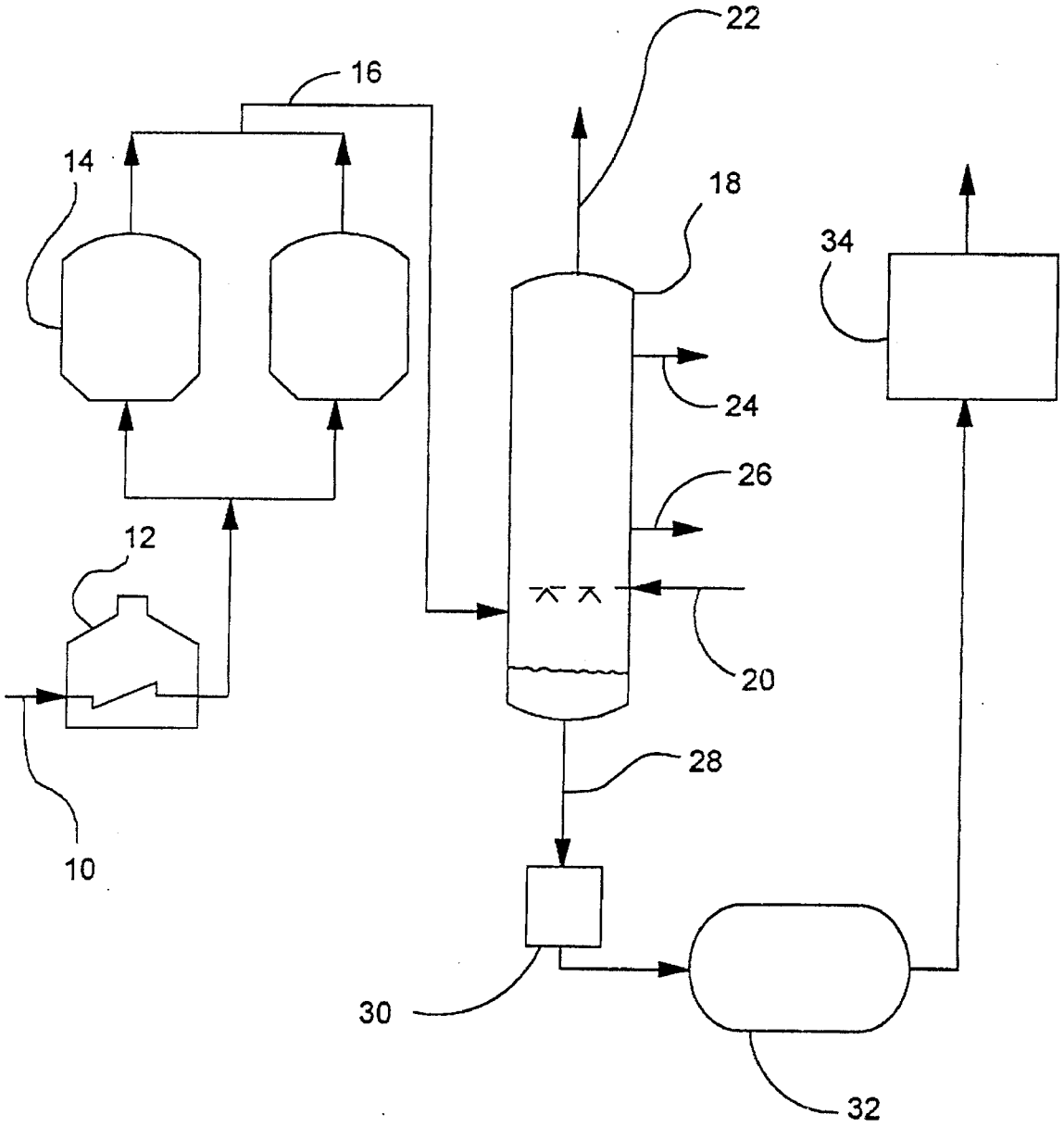
FIG. 2 is a schematic flowsheet showing a coking process incorporating the improvement provided by this invention.

FIG. 2 illustrates schematically the improvement of this invention over the prior art process. Common elements in FIGS. 1 and 2 are numbered alike. In FIG. 2, the FZGO is fed to filter 30. From filter 30 it goes to a hydroprocessing unit 32 and thence to an FCC unit 34.

Hydroprocessing unit 32 may be a hydrodesulfurizer or hydrocracker, but in any event is a hydrotreater unit containing a fixed catalyst bed. In the prior art, the FZGO stream could not be fed to a fixed bed catalytic hydrotreater because of rapid catalyst fouling from the suspended solids and viscous mesophase material. As a result, the FZGO stream, containing a high level of aromatic compounds, had to be fed unfiltered to an FCC unit where the product yield distribution from the FZGO was poor due to the high aromatic content. Additionally, the FZGO stream often contains sulfur in an amount that presents problems with product specifications. In some instances, the FZGO stream had to be used in lower value streams such as for process fuel.

It was determined that if substantially all of the suspended solids above about 25 microns in diameter could be removed from the FZGO stream, the stream could be fed to a fixed bed catalytic hydrotreater without fouling the catalyst bed. A 25 micron cut removes a major portion of the total suspended solids, and the remaining smaller particles pass through the catalyst bed without presenting a serious fouling problem.

Any filter which effectively removes substantially all of the 25 micron and larger particles could be used in the process of this invention. Filters removing even smaller particles, Such as down to about 10 microns, can be used, but tend to not be as cost effective.

A particularly effective filter for the process is an etched metal disc filter of the type marketed by PTI Technologies Inc. of Newbury Park, Calif. The etched metal disc filter comprised of one or more filter elements formed of multiple stacked discs is extremely effective, is easily regenerated, and is relatively easy to operate and control. The regeneration step, which involves backflushing with a charge of high pressure gas, with or without a following solvent flush, only takes a period of from one half to four minutes, so it feasible to operate with only one filter unit, as the feed to the filter can be retained in a surge tank or the like during the backflushing step. Alternatively, two or more filter units can be manifolded together and individually backflushed so that the feed through the filter is continuous.

Figure 3:
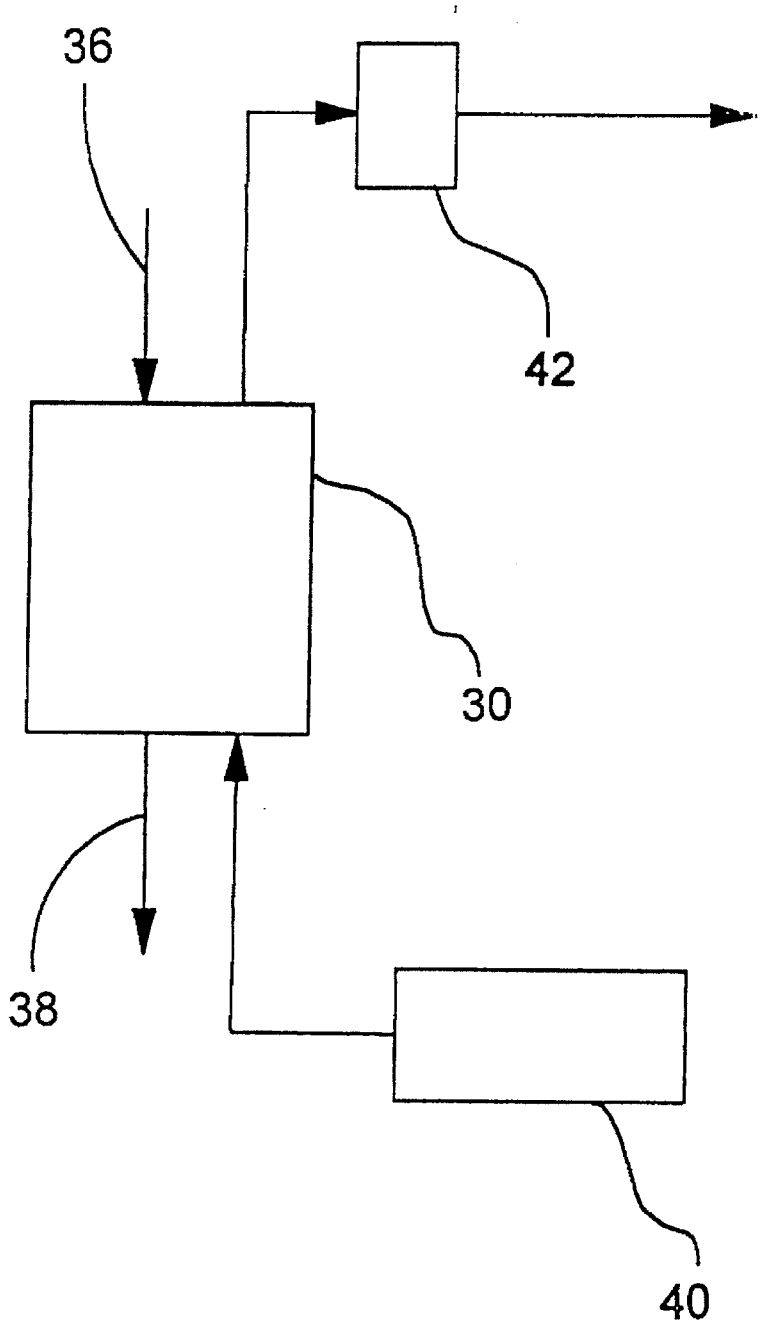
FIG. 3 is a schematic flowsheet representing a filter of the type utilized in the present invention.

A preferred filter is shown schematically in FIG. 3 including filter unit 30, feed line 36, filter output line 38, gas accumulator 40, and backflush holding tank 42. In operation, FZGO from line 36 is fed to filter unit 30 and exits via line 38. When the back pressure in filter 30 reaches a preset level, feed to the unit is stopped, and a quick-opening valve (not shown) on accumulator 40 is opened. Pressurized gas from accumulator 40 flows back through filter unit 30 and washes accumulated solids from the filter surface to a holding tank 42 or to a suitable process unit or disposal site. Preferably the filter is designed to cycle when the back pressure reaches a preset level. It has been found that the backpressure is reduced to near zero after the backflush cycle, indicating substantially complete removal of accumulated solids. As mentioned earlier, a solvent backflush can be used following the pressurized gas regeneration step if desired.

OPERATION OF THE MOST PREFERRED EMBODIMENT

The most preferred embodiment of the invention will now be described with reference to FIG. 2.

Coker feed from coker furnace 12 is fed to one of coke drums 14, and coker vapors are fed to the bottom of fractionator 18. A heavy-gas oil stream from line 20 is sprayed into the flash zone of fractionator 18, where it contacts incoming feed, condenses heavier components and washes down suspended solids. A flash zone gas oil, containing condensed coker vapors, solids and viscous mesophase material, is withdrawn from fractionator 18 via line 28. Product streams from fractionator 18 are recovered via lines 22, 24 and 26. Flash zone gas oil (FZGO) from line 28 is passed to filter 30 where suspended solids larger than about 25 microns are removed. The filtered FZGO then passes to catalytic hydrotreating unit 32 (preferably a hydrodesulfurizing unit) where the FZGO is desulfurized and/or structurally modified to be more amenable to fluidized bed catalytic cracking. The filtered FZGO does not foul the catalyst bed in the hydrotreater, and the hydrotreated FZGO provides a lower sulfur content product and a better product distribution yield from the FCC unit than does FZGO that has not been hydrodesulfurized. As noted earlier, one or more filter units may be utilized With periodic or sequential backflushing to maintain throughput, and the removed solids can be used or disposed of.

EXAMPLE I

In this example, 440 barrels per stream day of a flash zone gas oil stream from a commercial coker was fed to an etched metal disk filter designed to remove particles above 25 microns in size. The filtered stream was passed directly to an FCC unit for the first two weeks of the test, to confirm that the filter in fact removed substantially all of the particles larger than 25 microns. After confirmation of the effectiveness of the filter, the filtered stream was then fed to a fixed bed catalytic hydrotreater for several weeks.

The filter was designed to automatically backflush when the pressure drop across the filter reached 20 psi. The pressure drop across the filter immediately after backflushing was near zero, indicating effective backflushing. During the coke drum fill cycle, the filter backflushed about every 2 hours.

About 50 volume percent of the particulate material in the flash zone gas oil was greater than 25 microns. The filtered stream contained no particulate material greater than 25 microns, and the particulate material content of the filtered stream was low enough that no operating difficulties were encountered during the weeks that the filtered stream was fed to the hydrotreater. Table 1 below shows the results of the filter operation for days in which analysis of suspended solids were made.

TABLE 1

| | | Team/Stream | | | | | |
|---|---|---|---|---|---|---|---|
| | | FZGO(in) | FZGO(in) | FZGO(in) | FZGO(out) | FZGO(out) | FZGO(out) |
| | | Test Day | | | | | |
| | | A | B | C | A | B | C |
| Total Suspended Solids, WT % | | 0.0507 | 0.0884 | 0.033 | 0.0208 | 0.0082 | 0.0273 |
| Dist. (Microns) | Volume Percent | | | | | | |
| 1–2 | 2 | 0.05 | 0.12 | 0.05 | 0.13 | 0.03 | 0.12 |
| 2–4 | 4 | 1.90 | 7.52 | 3.41 | 5.97 | 2.03 | 6.64 |
| 4–8 | 8 | 4.63 | 22.22 | 14.25 | 29.19 | 8.70 | 23.31 |
| 8–16 | 16 | 7.11 | 25.90 | 18.29 | 36.08 | 35.65 | 32.99 |
| 16–22 | 22 | 9.95 | 14.74 | 12.61 | 28.63 | 53.58 | 36.94 |
| 22+ | | 76.36 | 29.50 | 51.39 | 0.00 | 0.00 | 0.00 |
| Total | | 100.00 | 100.00 | 100.00 | 100.00 | 100.00 | 100.00 |

The above example illustrates the effectiveness of an etched metal disk filter in removing suspended solids from a flash zone gas oil such that the filtered stream can be processed in a fixed bed catalytic hydrotreater without the catalyst bed fouling that would occur with an unfiltered stream.

While certain embodiments and details have been shown for the purpose of illustrating this invention, it will be apparent to those skilled in this art that various changes and modifications may be made herein without departing from the spirit or the scope of the invention.

We claim:

1. In a delayed coking process in which overhead vapors from a coking drum are fed to a coker fractionator where said vapors are separated into an overhead vapor stream, intermediate liquid streams, and a flash zone gas oil stream containing a substantial amount of particulate solid material, the improvement comprising:

(a) subjecting said flash zone gas oil stream to a filtration step to reduce the amount of particulate solid material therein; and (b) passing the filtered flash zone gas oil stream from step (a) to a fixed bed catalytic hydroprocessing unit.

2. The delayed coking process of claim 1 wherein said filtration step removes substantially all of the particulate solid material having a particle size greater than 25 microns.

3. The delayed coking process of claim 1 wherein said catalytic hydroprocessing unit is a hydrocracking unit.

4. The delayed coking process of claim 1 wherein said catalytic hydroprocessing unit is a hydrodesulfurizer.

5. The delayed coking process of claim 4 wherein hydrodesulfurized flash zone gas oil from said hydrodesulfurizer is fed to an FCC unit.

6. The delayed coking process of claim 1 wherein said filtration step includes filtration through a filter element comprised of a stack of etched metal discs.

7. The delayed coking process of claim 6 wherein said filter element is periodically backflushed.

8. The delayed coking process of claim 7 wherein a plurality of filter elements are utilized, and said elements are sequentially backflushed so that at least one filter element is always available on stream for removing solids from said flash zone gas oil.

* * * * *